United States Patent [19]

Thie et al.

[11] Patent Number: 4,844,446

[45] Date of Patent: Jul. 4, 1989

[54] MULTIPLE-COMPARTMENT CURRENCY STACKER-SORTER

[75] Inventors: Matthew G. Thie; James D. Miller, both of Indianapolis, Ind.

[73] Assignee: Standard Change-Makers, Inc., Ind.

[21] Appl. No.: 937,613

[22] Filed: Dec. 3, 1986

[51] Int. Cl.[4] ..... B65H 39/10

[52] U.S. Cl. ..... 271/296; 271/181

[58] Field of Search ..... 271/296, 300, 302, 306, 271/177, 180, 181, 84

[56] References Cited

U.S. PATENT DOCUMENTS

| | | | |
|---|---|---|---|
| 2,328,317 | 8/1943 | Wentworth . | |
| 3,129,824 | 4/1964 | Levy | 271/300 X |
| 3,655,186 | 4/1972 | Bayha . | |
| 3,843,115 | 10/1974 | Di Fulvio et al. . | |
| 3,917,260 | 11/1975 | Okkonen et al. . | |
| 4,000,892 | 1/1977 | Novak et al. . | |
| 4,011,931 | 3/1977 | Wyckoff . | |
| 4,050,562 | 9/1977 | Schwippert | 271/180 X |
| 4,141,546 | 2/1979 | Queener | 271/296 X |
| 4,179,685 | 12/1979 | O'Maley . | |
| 4,418,824 | 12/1983 | Gorgone et al. . | |
| 4,442,541 | 4/1984 | Finkel et al. . | |
| 4,473,157 | 9/1984 | Hirose et al. . | |
| 4,517,451 | 5/1985 | Kokubo et al. . | |

OTHER PUBLICATIONS

Rowe Field Service Manual and Parts Catalog, BC-35 Bill & Coin Changer, Mar. 1986, pp. iii, v, 0, 1, 3, 9, 15, 86, 96-96c, 100-105, 109-110, 112-113, 142-145.

*Primary Examiner*—Richard A. Schacher

[57] ABSTRACT

A currency stacker-sorter having a movable receiver which receives a bill from a currency validator and carries the bill laterally to a position opposite the inlet of a selected one of a plurality of storage boxes, whereupon a ram mechanism is activated to place the bill into the selected storage box. The currency stacker includes a closed-loop position control system for selectively positioning the receiver mechanism at a desired location, the position control system including an optical encoder for sensing the position of the receiver mechanism relative to the inlets of the storage boxes. The ram mechanism also includes an optical encoder which allows that mechanism to complete a ram sequence in response to a single trigger pulse from the currency validator. Each storage box of the stacker-sorter includes a spring-loaded pressure plate connected to a rear portion of the box through a scissors linkage. Each compartment also includes a compartment FULL switch.

27 Claims, 9 Drawing Sheets

MULTIPLE-COMPARTMENT CURRENCY STACKER-SORTER

BACKGROUND OF THE INVENTION

This invention relates to stacker-sorters, and particularly to currency stacker-sorters.

It is often desirable in commerce to stack currency and, prior to stacking, to sort the currency by denomination. Currency stacking is a standard feature in currency validators, which require some means for orderly storage after validation of a bill. Some validators also sort currency, storing each denomination in a separate compartment. A number of stacking techniques and sorting techniques have been proposed, as illustrated by the following patents:

| U.S. Pat. No. | Inventor | Issue Date |
|---|---|---|
| 3,655,186 | Bayha | Apr. 11, 1972 |
| 3,917,260 | Okkonen et al. | Nov. 4, 1975 |
| 4,000,892 | Novak et al. | Jan. 4, 1977 |
| 4,011,931 | Wyckoff | Mar. 15, 1977 |
| 4,418,824 | Gorgone et al. | Dec. 6, 1983 |
| 4,473,157 | Hirose et al. | Sep. 25, 1984 |
| 4,517,451 | Kokubo et al. | May 14, 1985 |

Kokubo et al., Hirose et al. and Gorgone et al. disclose currency stackers which are capable of sorting currency by denomination. Gorgone et al. discloses a dual stacker having a receptacle for temporarily receiving a note from a slot acceptor, and a pair of stacking compartments, one on each side of the receptacle. Such a design suffers from lack of versatility in that it cannot sort currency into more than two stacks. Although some state-of-the-art currency validators sense two denominations, others sense three or more, and therefore it would clearly be advantageous to employ a general purpose design capable of implementation in various stacker-sorter models having different numbers of storage boxes.

Kokubo et al. and Hirose et al. disclose stacker-sorters having three or more compartments in which currency is transferred by means of mechanically complex belt drive mechanisms.

SUMMARY OF THE INVENTION

The present invention provides a multiple-compartment currency stacker-sorter having a plurality of currency stacking boxes arranged in parallel and each having an inlet on one side, and including a movable receiver for temporarily receiving a bill to be stored in one of the storage boxes. A guide is provided for guiding the receiver along a path on the inlet side of the storage boxes, and a position controller selectively positions the receiver at a location on the guide opposite the inlet of any one of the storage boxes, whereupon a ram mechanism moves the bill from the receiver through an inlet opposed thereto and into the associated storage box.

Another aspect of the present invention is the method of stacking and sorting currency according to which a bill is temporarily deposited into a receiver which is bidirectionally movable in a straight guide path on one side of a plurality of currency storage boxes each having an inlet. The receiver is positioned at a location on the guide path opposite the inlet of a selected one of said storage boxes, and the bill is then moved from the receiver through the inlet opposed thereto and into the associated storage box.

It is a general object of the invention to provide an improved multiple-compartment stacker-sorter.

Another object of the invention is to provide a multiple-compartment currency stacker-sorter which is readily adaptable for use in existing state-of-the-art currency validators capable of sensing two or more currency denominations.

A further object of the invention is to provide a versatile currency stacker-sorter which is relatively simple in construction yet reliable and easily manufactured and maintained.

These and other objects and advantages of the present invention will become more apparent upon a reading of the following detailed description of the preferred embodiment taken in conjunction with the accompanying drawings.

DESCRIPTION OF THE PREFERRED EMBODIMENT

Figure 1:
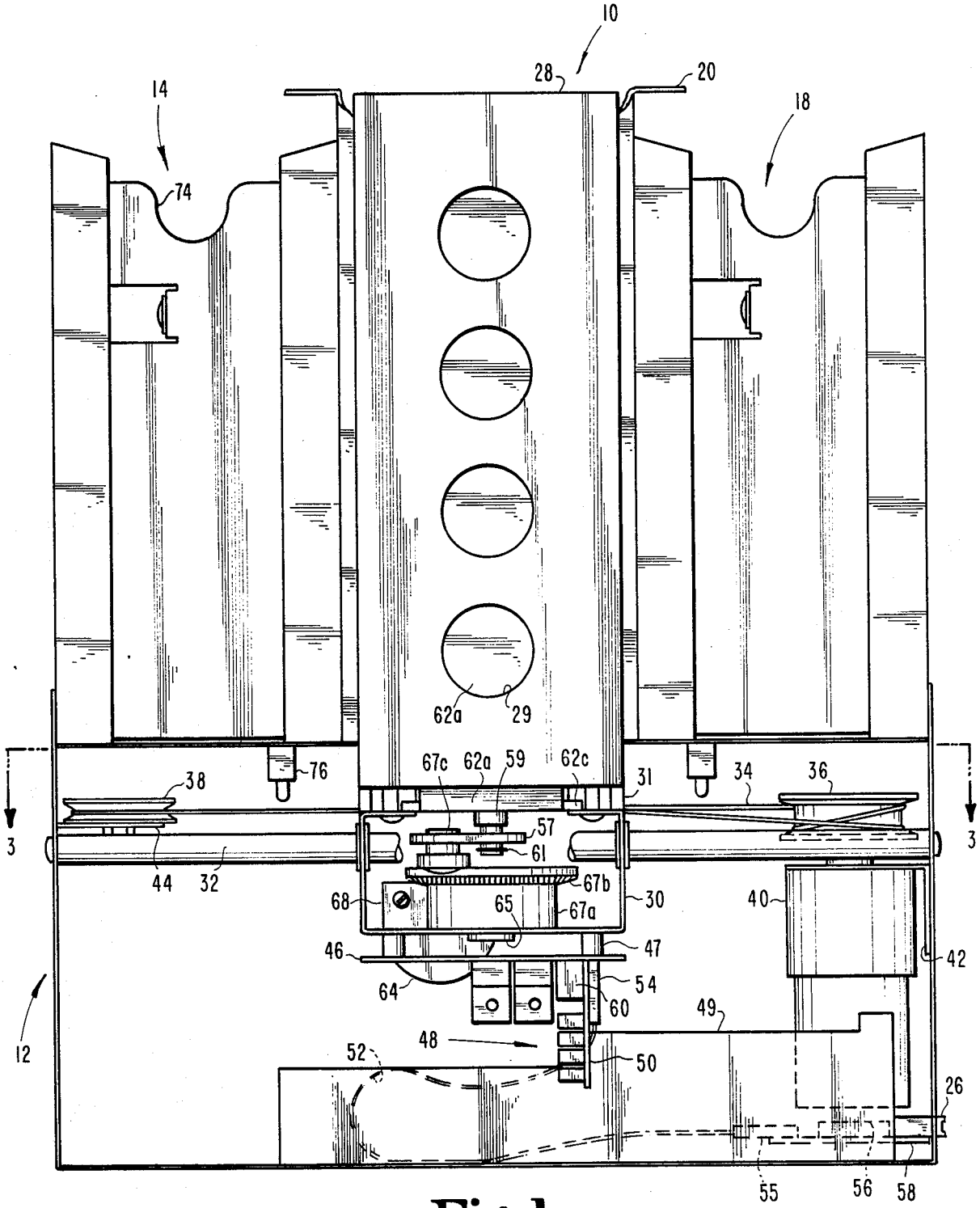
FIG. 1 is a front elevation view of a three-compartment currency stacker-sorter according to the present invention, with a portion of the guide bars broken away to show details of the ram drive mechanism.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
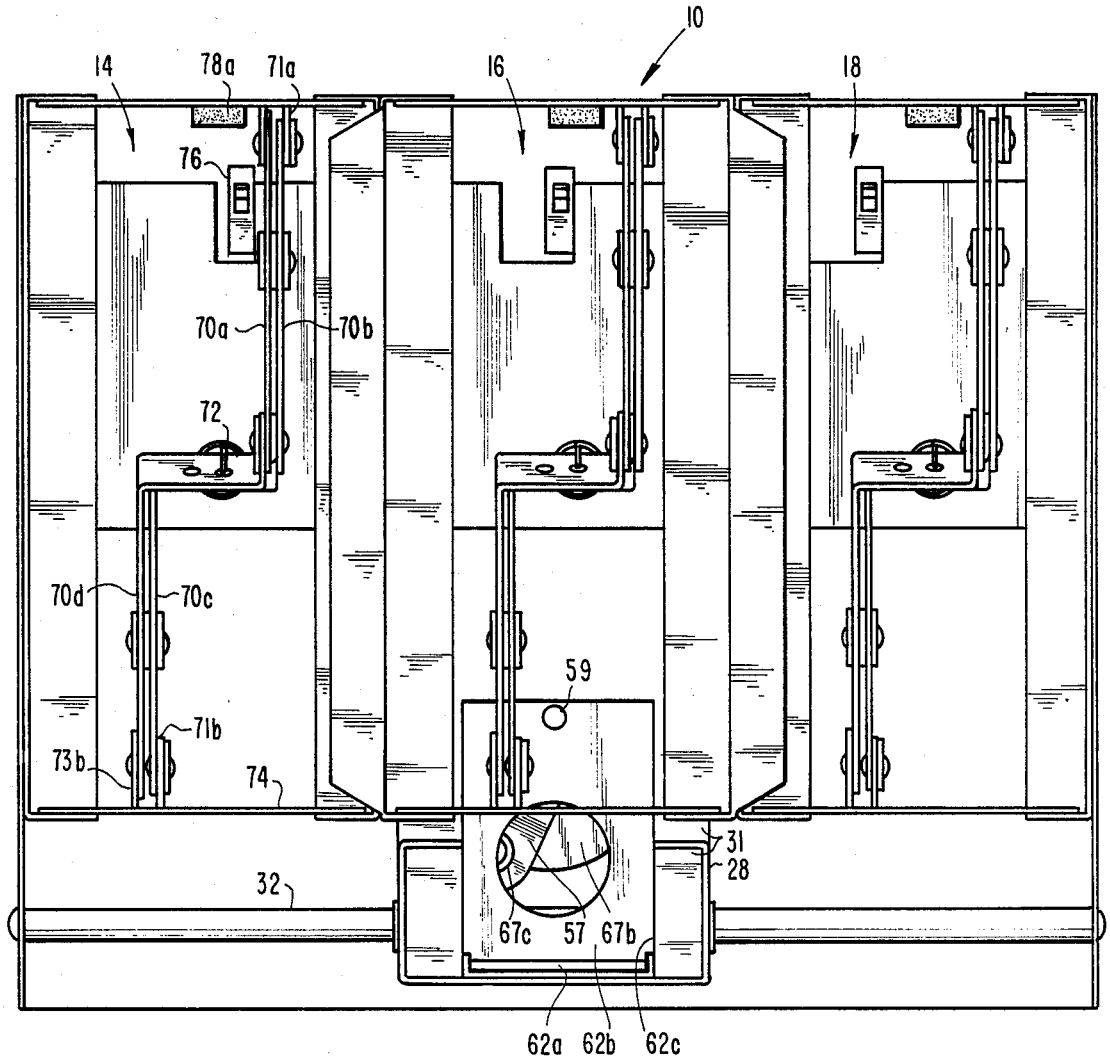
FIG. 2 is a top plan view of the stacker-sorter of FIG. 1, with the position motor, drive cable, ribbon cable and interconnect board removed for ease of illustration.

FIGS. 1 and 2 illustrate the front and top views, respectively, of a three-compartment currency stacker-sorter 10 which is set forth herein as an exemplary embodiment of a multiple-compartment stacker-sorter according to the present invention. It will be readily understood by those skilled in the art that the techniques of the present invention are applicable to stacker-sorters having two or more storage boxes. Stacker-sorter (hereafter stacker) 10 has a base 12 connected to three interconnected compartments or storage boxes 14, 16 and 18. Stacker 10 is intended to be used with a currency validator or verifier capable of sensing three denominations, one for each compartment, and of transporting validated bills to the stacker along with information indicating the bill denomination. The preferred validator is a slot acceptor of the type having a bottom exit slot for release of currency endwise in a downward vertical path.

With combined reference to FIGS. 1–4, a bill receiver 28 is provided for receiving bills from the validator for sorting and stacking. Bill receiver 28 is supported on a carriage 30 by means of an intermediate retaining plate 31, and the carriage is slidably mounted on parallel guide bars 32 such that a guide path is defined for receiver 28 along the inlet side, i.e., the front side, of the storage boxes. Stacker 10 is mounted upright under the validator with the validator exit slot parallel to guide bars 32 and directly over the top opening of receiver 28 when the receiver is in the position shown, such that bills released from the validator may fall endwise into the receiver. Stacker 10 is supported by flanges 20 which mate with corresponding flanges provided on the validator for this purpose. The drawings illustrate the resting or home position for receiver 28, which is movable laterally in a reciprocating manner under control of a closed-loop position control system which responds to commands from the validator through input/output (I/O) connector 26. As will be described in detail, bills accepted by the currency verifier are released into receiver 28 when it is in its home position, and the receiver is then positioned at a location opposite the inlet of a designated one of boxes 14, 16 or 18 for storing the validated bill in the designated box.

Although gravity feed is preferred, validated bills may alternatively be transported to the receiver in other ways, and the stacker-sorter may be mounted in other than an upright position depending on the transport mechanism. Also, of course, the home position of the receiver may be other than the center position.

Figure 3:
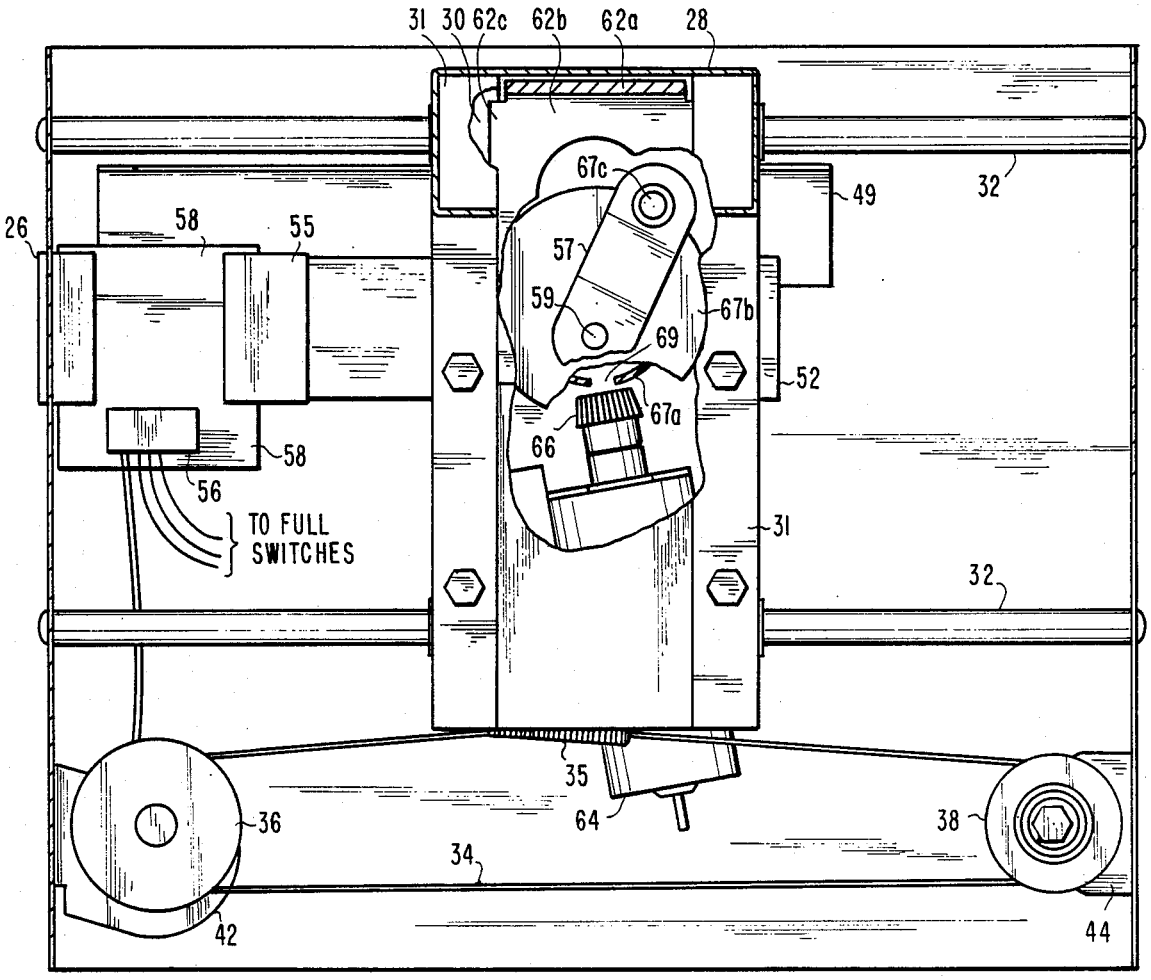
FIG. 3 is a top sectional view of the stacker-sorter of FIG. 1 taken along lines 3—3, with portions broken away to show underlying details.
Figure 4:
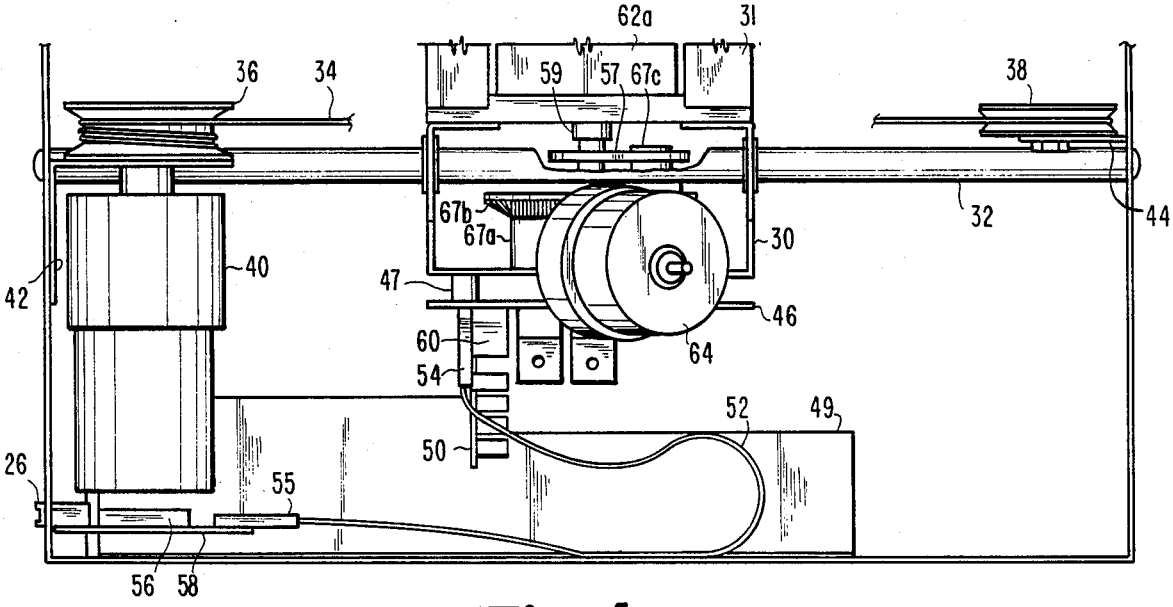
FIG. 4 is a rear elevation view of the portion of the stacker-sorter shown in the sectional view of FIG. 3, with portions broken away.
Figure 7:
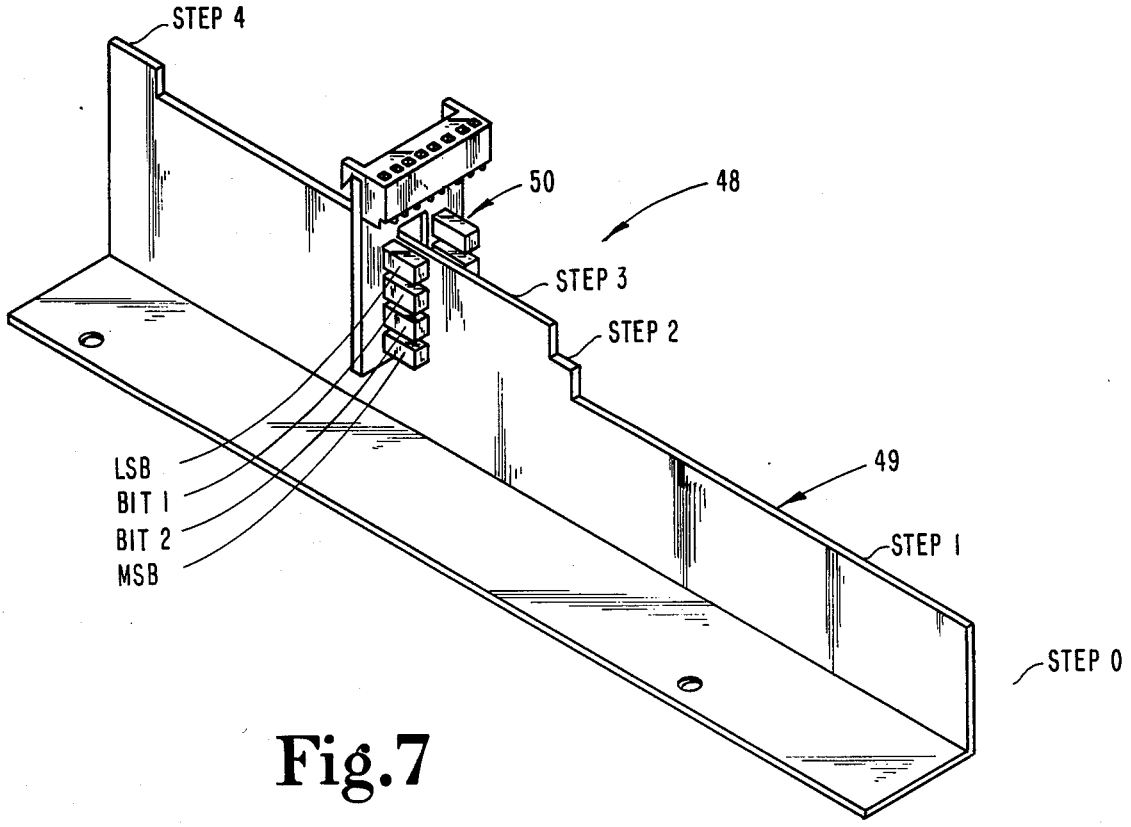
FIG. 7 is an isometric view of the optical encoder of the currency stacker-sorter shown in FIG. 1.

Carriage 30 is driven along guide bars 32 by a drive cable 34 which, as shown in FIG. 3, is attached on both ends to retaining plate 31 and wound around a drive spool 36 and an idler pulley 38, with a spring 35 provided on one end of cable 34 for cable tension. Drive spool 36 is connected to the output shaft of a reversible DC motor 40 which is mounted on the side of base 12 by means of a mounting bracket 41. Motor 40 is preferably a Canon M-33968 24 VDC motor, rated at 140 RPM. Spring 35 is preferably rated for a five-pound maximum load. A similar mounting bracket 44 holds idler pulley 38 in place on the opposite side of the base 12. An electronic circuit 46 includes control circuitry which controls position motor 40, and thereby controls the position of receiver 28, as a function of command signals received from the currency verifier through I/O connector 26 and of feedback signals received from an optical encoder 48. Circuit 46 is mounted on carriage 30 with spacers 47 and is electrically connected to motor 40 and I/O connector 26 through a flexible cable 52, associated connectors 54, 55, and 56, and an interconnect circuit board 58. Optical encoder 48 includes an encoder bar 49 and an optical detector 50, as shown in FIG. 7 in an isometric view, and an output circuit in circuit 46; optical detector 50 is electrically connected to the encoder output circuit through connector 60. As will be described in greater detail with reference to FIG. 8, optical encoder 48 indicates the actual position of the receiver, and a comparator in circuit 46 compares the position signal from optical encoder 48 with a command signal from the currency verifier indicating a desired receiver position. If the desired and actual positions are different, position motor 40 is energized so as to pull carriage 30 along guide bars 32 into the desired position.

The carriage also carries a ram mechanism for moving a bill from the receiver 28 through the inlet of a designated storage box. The ram mechanism includes a ram **62*a* normally located within receiver 28 and supported vertically by a horizontal plate 62*b* with which it is integrally formed and through which it is driven by a ram motor 64 and associated drive linkage. Plate 62*b* is connected by a pin 59, a connecting rod 57, and gears 66 and 67 to ram motor 64. Gear 67 has a hollow cylindrical base 67*a*, a bevel gear 67*b* atop the base, and a peripheral pin 67*c* atop the bevel gear, all preferably integrally formed of plastic, and it is rotatably mounted on carriage 30 by a bolt 65 extending vertically through base 67*a* and engaging a matching nut (not shown). Connecting rod 57 is rotatably mounted on pins 59 and 67*c* and is secured to pin 67*c* by an E-clip 61. Bevel gear 67*b* engages gear 66, which is a matching bevel gear mounted on the ram motor output shaft. The left and right edges 62*c* of plate 62*b* are slidably secured in a pair of longitudinal slots formed between the top of carriage 30 and a notch provided on the underside of retaining plate 31 for this purpose. The assembly acts as a bell-crank mechanism, moving ram 62*a* in a reciprocating manner out of the receiver into a storage box and back thereby pushing nay bill contained in the receiver into a particular storage compartment. Upon completion of one revolution of a slot 69 in base 67*a*, as sensed by optical detector 68, ram motor 64 stops, leaving the ram in its home position inside the receiver. Preferably detector 68** is a TRW Optron OPB804.

Figure 5:
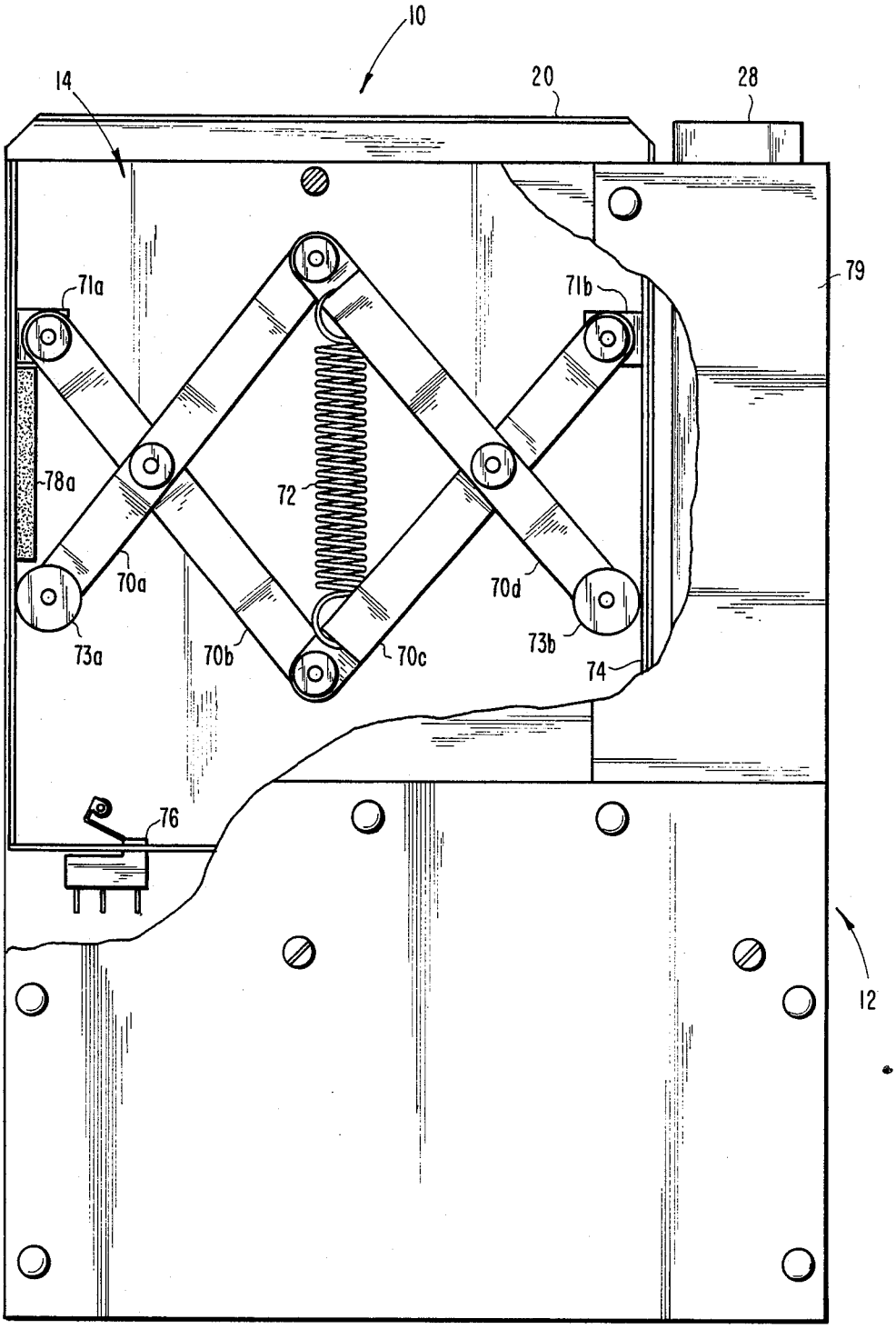
FIGS. 5 and 6 are left side elevation views of the stacker-sorter of FIG. 1., with a cover added over the receiver, and with a portion of the left wall removed to show interior details.
Figure 6:
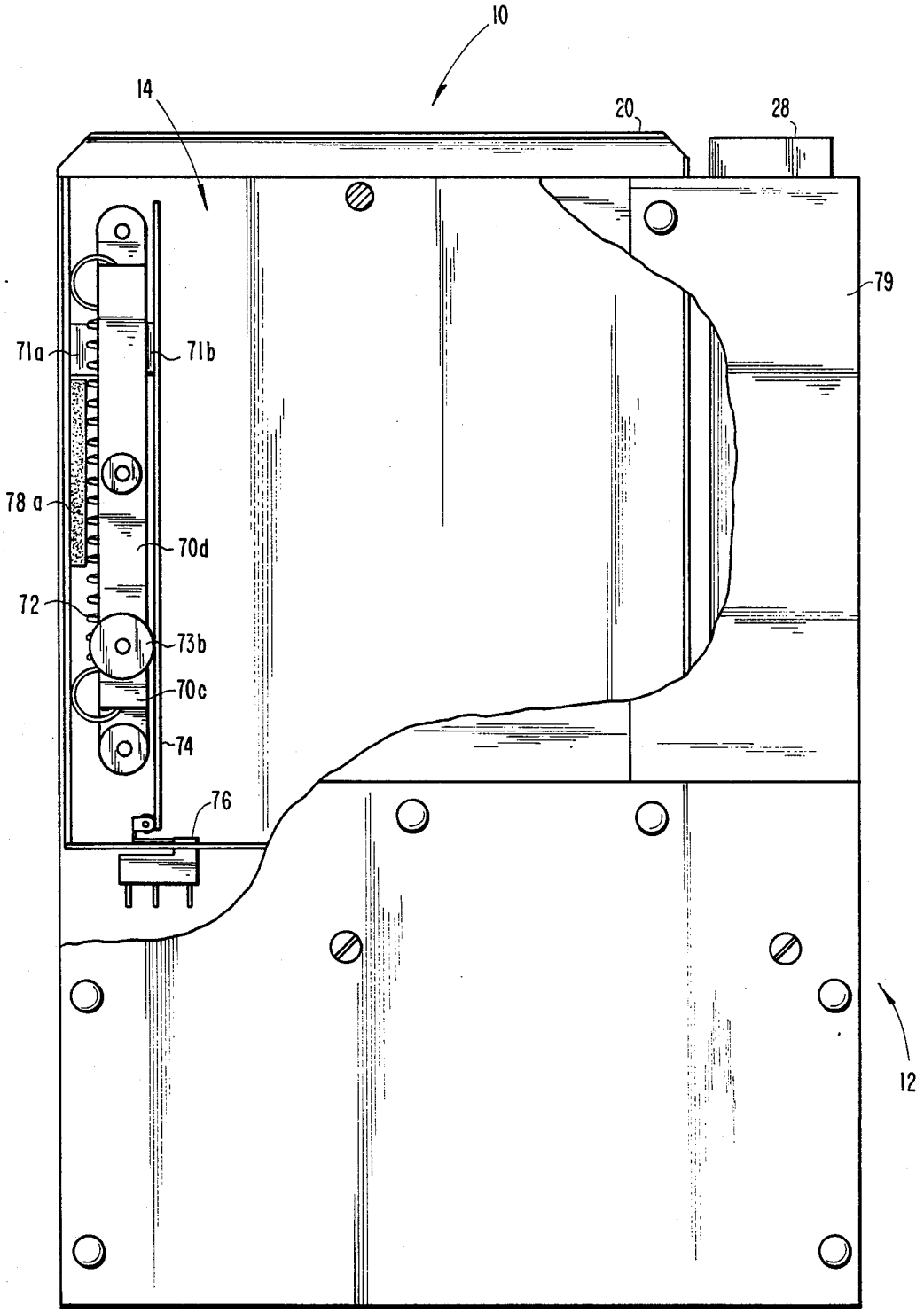

Referring now to FIGS. 2, 5 and 6, each storage compartment has a front door 74 which is biased by a spring-loaded scissors mechanism to a closed position as shown in a top view in FIG. 1 and in a side view in FIG. 5. Each scissors mechanism includes four linkages **70*a*, 70*b*, 70*c* and 70*d*, with linkages 70*b* and 70*c* attached respectively to tabs 71*a* and 71*b* formed in the back wall of the compartment and in door 74. The linkages are pivotably interconnected as shown, and a tension spring 72 is connected between linkages 70*c* and 70*d* to bias the scissors mechanism toward the open position shown in FIG. 5. Rollers 73*a* and 73*b* are provided on the ends of linkages 70*a* and 70*d*, respectively, to reduce wear from repetitive motion of the scissors mechanism. As bills are stacked in each storage box, the door 74 is forced rearward into the box, ultimately reaching the position shown in FIG. 6 when the box is full. This condition is sensed by a FULL switch 76 mounted on a vertical tab extending downward from the floor of the box. Each FULL switch 76 is a normally open switch which comes into contact with its associated door 74 when the stack of bills reaches the size sufficient to force the door to the position shown in FIG. 6. After a FULL switch closes no further bills will be loaded into the corresponding storage box. Also shown in FIGS. 5 and 6 is a front cover 79 for the receiver. Although not shown, in actual use covers are provided for both the front and back of base 12** as well.

Turning now to FIG. 7, the isometric drawing of optical encoder 48 shows in detail the relationship between encoder bar 49 and optical detector 50. Encoder bar 49 has four steps above a base level referred to herein as step 0. Optical detector 50 is an assembly of four Optec K8030 matched sensor pairs respectively positioned at the levels of the four steps of the encoder bar. Optec is a division of Crown Semiconductor, Inc,. 345 Industrial Blvd., McKinney, Tex. 75069. The individual detectors in the assembly each have an optoelectronic source and sensor and each generate a single bit output which is high (1) when the light beam passing from source to sensor is interrupted by bar 49 and low (0) when the light beam reaches the detector. The individual detector outputs together form a four-bit code with bit designations as shown in the drawing. The ones complement of this four-bit code is supplied to a comparator (IC4 in FIG. 8) as an actual position code for comparison with a command position code from the verifier. The actual position code indicates the position of detector 50 with respect to encoder bar 49, and correspondingly indicates the position of receiver 28 with respect to the storage boxes 14, 16 and 18, according to the following table, in which the leftmost bit of each code is the most significant bit (MSB):

| STEP | BOX | POSITION CODE |
|---|---|---|
| 0 | 14 | 1111 |
| 1 | — | 0111 |
| 2 | 16 | 0011 |
| 3 | — | 0001 |
| 4 | 18 | 0000 |

Steps 0, 2 and 4 on encoder bar 49 correspond, respectively, to storage boxes 14, 16 and 18, as shown above. More specifically, optical detector 50 straddles step 2 when receiver 28 is in its home position, opposite the inlet of box 16, and it moves laterally to step 0 or step 4 depending on whether receiver 28 is commanded toward box 14 or box 18, respectively. In each case motor 40 is stopped as soon as the position code for the target step is detected. Step 2 preferably extends 3/16" along the length of the bar. Its maximum size is a function of the relative widths of the ram and the storage box openings, and its minimum size is a function of the dimension along the bar of the sensor pairs in optical detector 50 as well as the field of view of the sensor pairs and the servo system dynamics.

It is apparent from the above table that the position code changes only one bit at a time as optical detector 50 proceeds from step to step. There is never a change of two or more bits at the same time such as would occur if the encoder were configured to provide position codes equal to the binary equivalent of the step number. In such a system bits 0 and 1 would both change state at the transition from step 1 to step 2 (from 0001 to 0010) and bits 0, 1 and 2 would all change state at the transition from step 3 to step 4 (from 0011 to 0100). With such a configuration erroneous data could be generated due to misalignment of individual optical detectors. In situations where misalignment is tolerable or can be corrected efficiently through quality control measures, this or other simpler position code formats may be suitable. However, single bit changes as shown in the above table are preferred in order to prevent erroneous data input.

The configuration using four detectors has the further, important advantage of providing the ability to sense the position of the receiver on power up. For example, if the original position of optical encoder 50 were as shown in FIG. 7, due to movement during shipment or turning off the machine with the receiver still in motion, the resulting actual position code would be 0001, which indicates that the receiver is between boxes 16 and 18. This is sufficient information for the position control system to move the receiver in the correct direction initially in response to any command position code.

The encoder bar could alternatively be configured with longitudinal slots arranged to indicate position, or it could employ a bar bearing reflective tape patterns detectable with optical detector assemblies having source and sensor on the same side of the bar. In either of these alternative configurations it would be desirable to use the position code format described above with respect to the preferred embodiment, so as to avoid possible errors due to imprecise machining of a slotted bar or application of reflective tape. A further alternative embodiment employs a simple three-step bar with a transition between steps 1 and 2 indicative of the home position. Since the position motor shaft takes some finite time to stop rotating after that transition is detected, this configuration would result in a slight difference in the resting position of the receiver depending on the direction from which the receiver approaches home.

Figure 8:
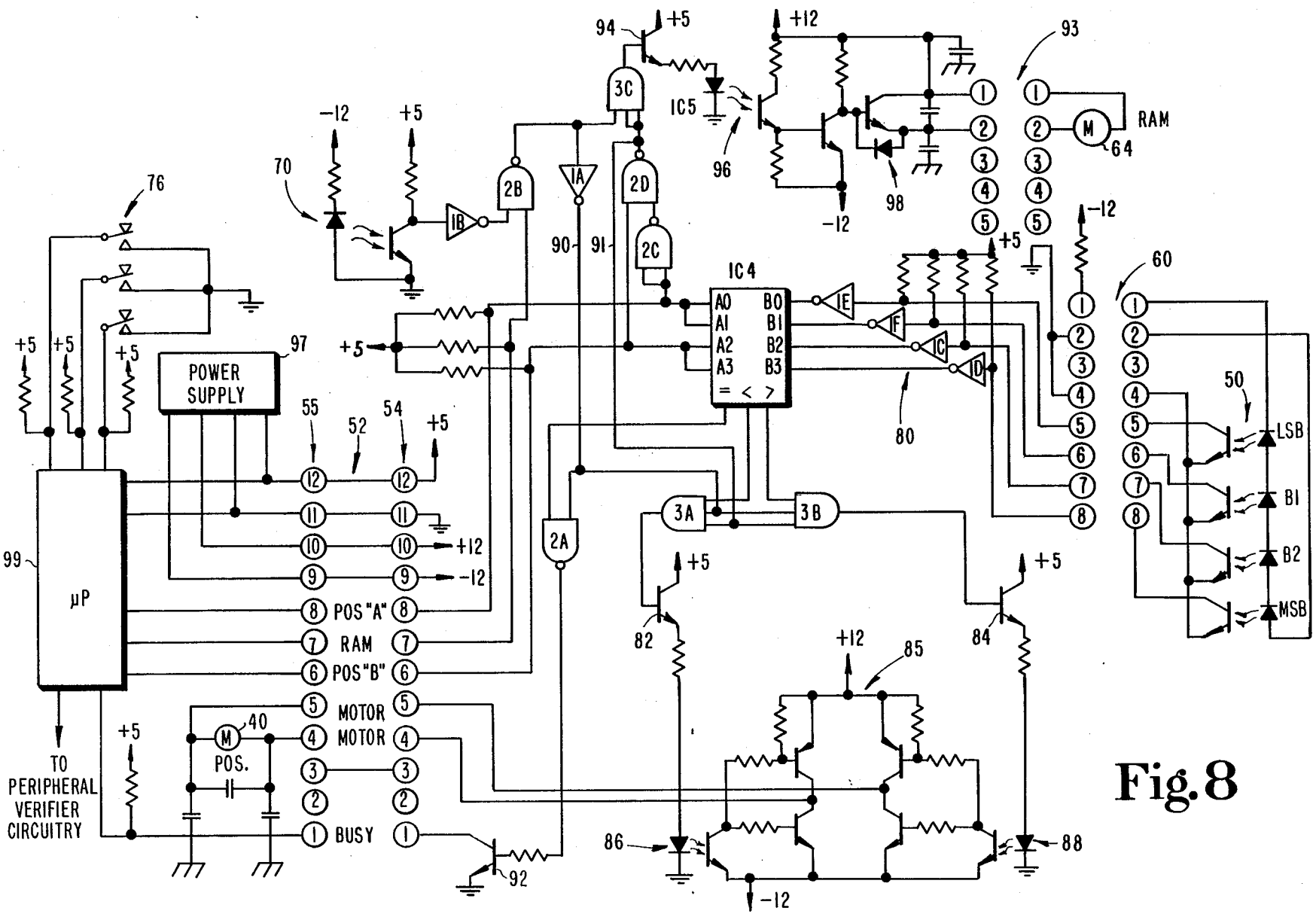
FIG. 8 is an electrical schematic of the circuitry of the currency stacker-sorter of FIG. 1.

FIG. 8 is an electrical schematic for electronic circuit 46 as well as the external devices connected thereto through connectors 54, 60 and 93, including microprocessor 99, power supply 97, position motor 40, ram motor 64, and optical detector 50. Circuit 46 operates with three power supply voltages supplied by power supply 97: +5 VDC and +12 VDC. All three supply voltages are referenced to signal ground (designated by earth ground symbol), which is connected to the microprocessor and, through pin 11 of connectors 55 and 54, to circuit 46. Signal ground is kept separate from chassis ground to electrically isolate circuit 46 from the chassis of the stacker and verifier and the outside power lines. However, AC coupling is provided between chassis ground and the position and ram motors to filter out motor-generated noise signals. The verifier also preferably has a visual display (not shown) for displaying status conditions, as will become apparent. As the schematic shows, the least significant bit (LSB), bits 1 and 2 and the MSB from optical detector 50 are coupled through an inverter/buffer 80 to respective inputs B0, B1, B2 and B3 of a four-bit magnitude comparator IC4. IC4 is a type 4585 CMOS magnitude comparator, commercially available from a number of vendors including Motorola. All the logic gates shown in FIG. 8 are commercially available CMOS devices. IC4 compares the value of the actual position code from optical encoder 48 with the value of a command position code received on the position "A" and "B" lines from microprocessor 99 through ribbon cable 52 and associated connectors (with the MSB on the "B" line). As shown in FIG. 8, the position "A" line is connected to inputs A0 and A1 of IC4, and the position "B" line is connected to inputs A2 and A3 of IC4. Only two bits are required from the currency verifier to control the position of receiver 28 because of the position coding provided by optical encoder 48. That is, in the position codes for the three storage boxes, bits 0 and 1 are identical for each code as are bit 2 and 3 for each code, as is apparent from the above table. Thus, an abbreviated code 11 can be used in the microprocessor to designate storage box 14, and similarly storage boxes 16 and 18 can be designated by codes 01 and 00, respectively. The remaining code, 10, is reserved for disabling all motor activity in the stacker, and is accordingly called the STACKER KILL code.

Figure 9:
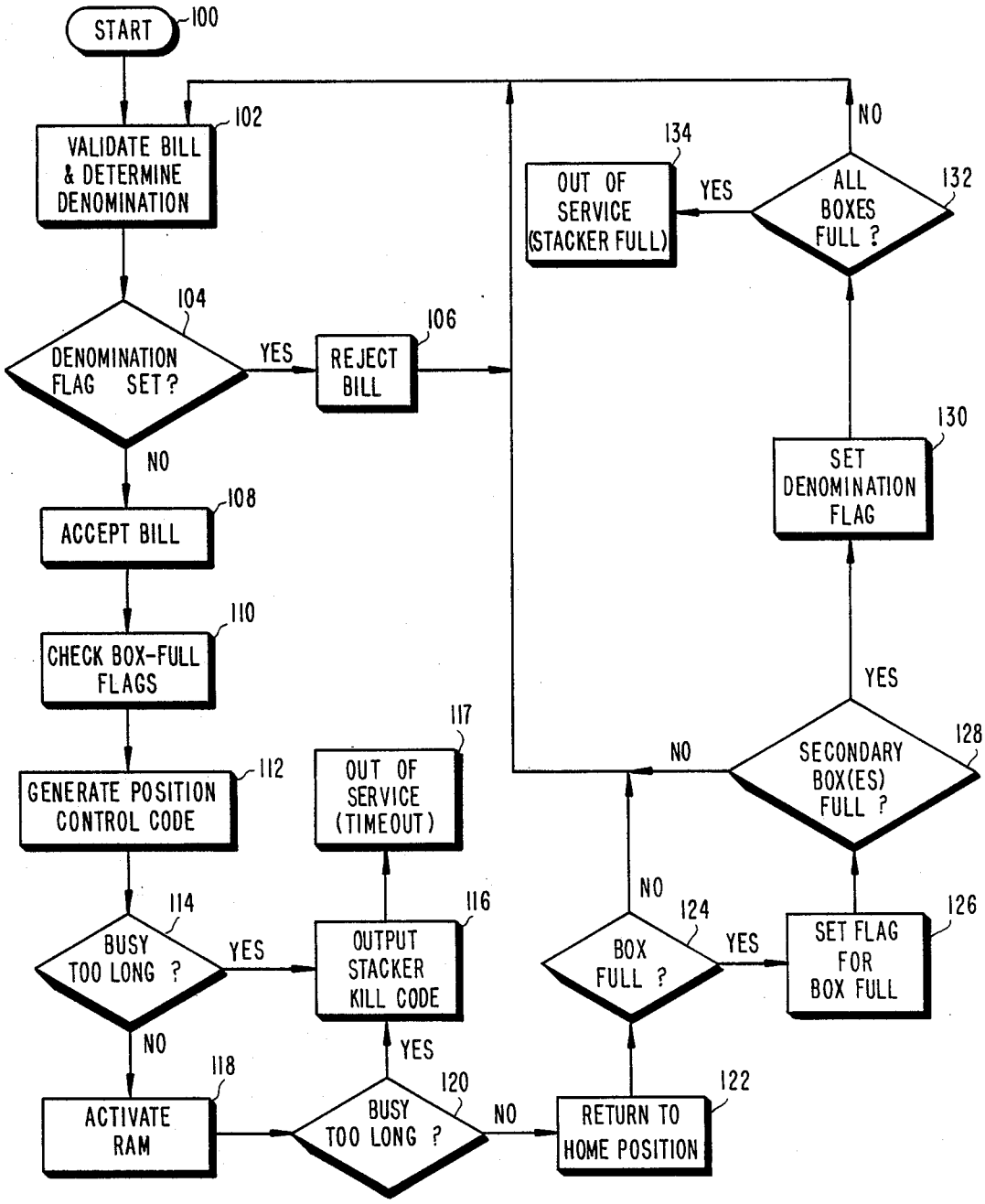
FIG. 9 shows a flow chart for the operations performed by the microprocessor which controls the operation of the stacker-sorter of FIG. 1.

Microprocessor 99 controls the currency verifier as well as stacker 10, and is accordingly connected to peripheral verifier circuitry such as sensors for currency verification and determination of bill denomination, as well as various motors and controls for bill transport and coin dispensing. Such peripheral circuitry is not important to this invention and is accordingly not discussed herein in detail. The operation of the microprocessor as it relates to this invention is illustrated in the flow chart of FIG. 9, and will now be described as part of the overall operation of the stacker. When the program starts at step 100, the receiver is in the home position, ready to receive a validated bill from the currency verifier. The currency verifier validates a bill and determines its denomination in step 102. If the subject bill is determined to be invalid, it is rejected and the verifier waits for another bill. If the subject bill is valid, however, program control proceeds to step 104 wherein the denomination flag is checked. Although the various blocks in the flow chart are described herein as steps, it will be understood by those skilled in the art that each step so described may actually be a series of steps in the program executed.

The stacker has the capability of storing bills in alternate, or secondary, boxes, and the microprocessor is externally programmable by an operator to predetermine secondary boxes. Although other applications will be apparent for secondary box assignments, one very useful application, described herein, involves storing bills of a common denomination in a secondary box after the primary box is full. The primary box for a less common denomination is preferred as the secondary box for a common denomination, and such a box may well serve as the secondary box for several denominations. The status of each FULL switch 76 is represented by a box-full flag in the microprocessor, and an additional flag is designated for each denomination which the verifier is programmed to accept. A denomination flag is set if the primary box and all secondary boxes designated for the particular denomination are full. If a denomination flag is set for the current validated bill, the verifier proceeds, in step 106, to reject the bill. Otherwise, the bill is accepted in step 108 and released from the verifier into receiver 28 of the stacker.

In step 110 the box-full flags are checked as necessary for the denomination of the validated bill to determine a box for storage of the bill, and then in step 112 a position control code is generated which corresponds to the box determined in step 110. The closed-loop receiver position control system described above operates in response to this position control code, moving as necessary to a position corresponding thereto. For example, if a $5 bill is validated in step 102, it is accepted if the $5 denomination flag is not set, which indicates that at least one box designated for $5 bills is not full. In such a case the validator finds an available box for the accepted $5 bill and generates a corresponding position control code. If box 14 is programmed as the primary storage box for $5 bills and its box-full flag is not set, the validator outputs command position code 11. Otherwise some secondary box is available for $5 bills, since the $5 denomination flag is not set, and the validator outputs a corresponding position code. Assuming that box 14 is available, however, the code 11 is generated and input to IC4 as 1111, for comparison with the IC4 B input code 0011 corresponding to the current (home) position of receiver 28.

IC4 generates motor control signals according to the relative states of the compared position codes. IC4 compares the values of the four-bit codes at its A and B inputs and determines whether A is equal to, less than, or greater than B, generating a high level on the appropriate one of the three corresponding outputs, which are connected respectively to gates 2A, 3A and 3B. The other two inputs to gates 3A and 3B are high during step 112, and only go low in response to a ram activation pulse or the STACKER KILL code, as will be explained later. Therefore, in step 112, if A is less than B, gate 3A generates a high output which turns on transistor 82, while transistor 84 is off due to the low state output of gate 3B. An H-switch output driver stage 85, connected to position motor 40 through the MOTOR lines in cable 52, is set in a particular state by the states of transistors 82 and 84 through optocouplers 86 and 88. Thus, neglecting transistor saturation voltages in the H-switch, +24 VDC or −24 VDC is connected to motor 40 according to the relative states of the A and B inputs to IC4. Motor 40 has three filter capacitors electrically connected thereto and to chassis ground as shown; the capacitors are mounted on interconnect board 58, which has an electrical connection to chassis ground.

In the example described above, where a $5 bill is accepted and code 11 (for box 14) is generated, IC4 outputs a "less than" signal which causes gate 3A to go high. The "greater than" output is low whereby gate 3B remains low. Consequently, motor 40 turns on and moves receiver 28 toward step 0 on encoder bar 49. When optical detector 50 reaches step 0 it outputs the corresponding position code of 0000, the ones complement of which (1111) is supplied to IC4. IC4 responds by generating a high output level on the "equal to" output. The "greater than" and "less than" outputs are then both low, and accordingly gates 3A and 3B both generate low outputs which in turn cause motor 40 to be turned off. Accordingly receiver 28 comes to a stop opposite the inlet of storage box 14.

The function of the BUSY line will now be described. With the receiver and ram in their home positions the initial conditions of both line 90 and the "equal to" output of IC4 are high and the output of NAND gate 2A is low. Therefore, transistor 92 is off whereby stacker 10 presents a high impedance on the BUSY line. The BUSY line input to microprocessor 99 is pulled high through an appropriate pull-up resistor. Once IC 4 receives a position code on its A inputs which is different from the current position code on its B inputs, the "equal to" output goes low, gate 2A goes high and turns on transistor 92 thereby pulling the BUSY line low. This busy signal inhibits the validation of currency to prevent a jam such as might be caused by an out-of-position receiver or ram. The "equal to" output of IC4 goes high again when receiver 28 reaches the desired position, which drives NAND gate 2A low and thereby turns off transistor 92. Consequently, the BUSY line is again pulled high. Currency stacker 10 thus signals to the currency validator that it is no longer busy. The time during which the stacker is busy is monitored by the microprocessor in step 114, and if the stacker is busy too long the program branches to step 116 in which the STACKER KILL code (10) is generated. This code causes control line 91 to go low thereby disabling AND gates 3A and 3B and in turn disabling the position motor. As will be seen, it also disables the ram motor through AND gate 3C. When the STACKER KILL code is generated, the currency verifier goes out of service and generates a corresponding "TIME OUT" display (step 117). Otherwise program control proceeds to step 118 for activation of the ram.

At this time the ram is in its home position, which is indicated by slot 69 in base 67*a* of gear 67. When the ram is in this home position the slot allows light to pass from the source to the sensor in optical detector 68, whereby the input to inverter 1B is normally low. Prior to initiation of the ram sequence, both inputs of NAND gate 2B are high and, accordingly, control line 90 is high. The currency validator initiates the ram sequence by transmitting a low pulse to stacker-sorter 10 on the RAM line, which as shown in FIG. 8 is connected to an input of NAND gate 2B. In response to this pulse, NAND gate 2B goes high and line 90 goes low. At this time the other two inputs to AND gate 3C from NAND gate 2D are both high, and so AND gate 3C goes high, turning on transistor 94 and, through optocoupler 96 and output driver stage 98, turning on ram motor 64. Control line 91 is held high by logic gates 2C and 2D for all position codes except 10, which, as indicated, is used to shut off all motor activity. Logic gates 3A, 3B and 3C are simultaneously enabled or disabled depending on the logic level of control line 91. The low level on line 90 during step 118 causes the BUSY line to go low, thereby indicating that the stacker is busy, and also disables gates 3A and 3B, thereby preventing receiver movement when the ram is active.

When the ram is pulsed it leaves its home position whereby base 67*a* interrupts the light beam in optical detector 68. As a result, the detector output goes high causing both inputs of NAND gates 2B to be momentarily low. Shortly thereafter the low input pulse on the RAM line is removed and that line returns to a high state, but the low level at the other input of NAND gate 2B, from the optical detector, keeps the gate output high and thereby permits the ram motor to continue to run. When the ram returns home optical detector 68 again goes low thereby gating the motor off through gates 1B, 2B and 3C. Control line 90 then goes high, and, since the "equal to" output of IC4 is high at this time, NAND gate 2A goes low and the BUSY line is pulled high, thereby signalling that the stacker is ready for the next command.

If for some reason the stacker is busy too long, as determined in step 120, the currency verifier outputs the STACKER KILL code and goes out of service as described above. The STACKER KILL code disables AND gate 3C, the output of which must be high for the ram motor to operate, and thereby disables the ram motor. If the busy condition terminates as expected within a predetermined time, the microprocessor proceeds in step 122 to generate the home position code (01) to cause the receiver to return to the home position. It will be appreciated from the foregoing that the BUSY signal also serves as the means for detecting a jammed condition since the normal duration of the busy signal is predictable.

Figure 10:
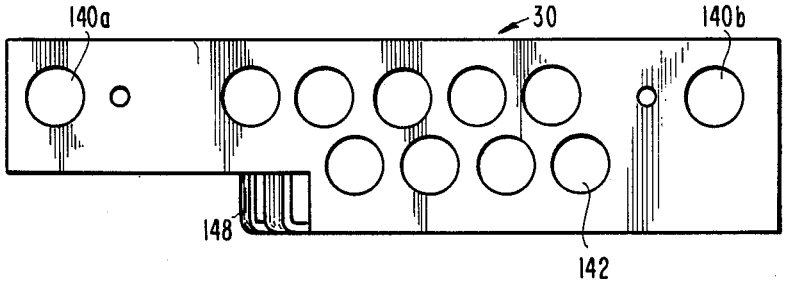
FIGS. 10 and 11 respectively show side and bottom views of the carriage in the stacker-sorter of FIG. 1.
Figure 11:
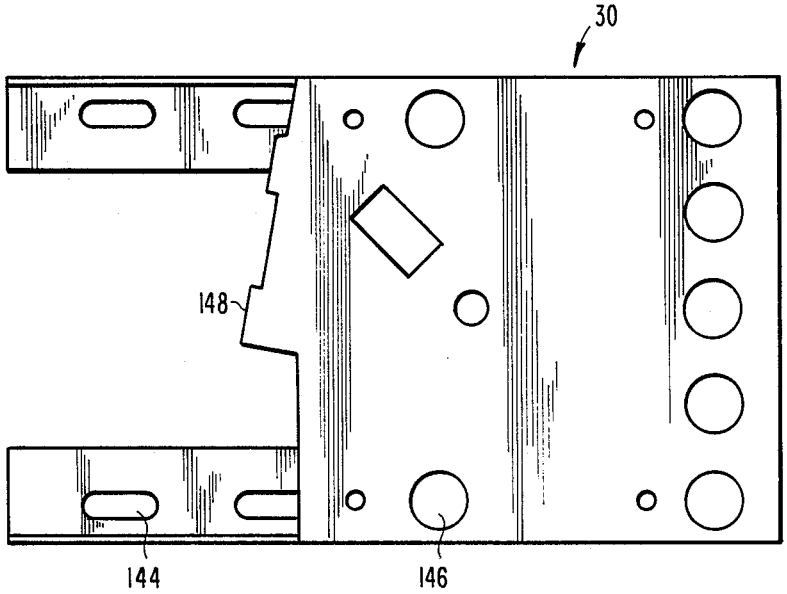

In the next step, step 124, microprocessor 99 checks the status of the FULL switch for the box just loaded with a bill. As shown in FIG. 8, the common terminal of each FULL switch 76 is connected to the microprocessor and is connected to +5 VDC through an appropriate pull-up resistor. The normally open contact of each FULL switch is connected to ground. If the box just loaded is full, the flag is set for that particular box in step 126. Otherwise program control returns to step 102 for validation of another bill. If all secondary boxes for the denomination in question are also full, as determined in step 128, the corresponding denomination flag is set in step 130. If a secondary box is determined not to be full, program control returns to step 102. After setting a denomination flag in step 130, decision step 132 is performed, in which the microprocessor determines whether all boxes are full. If they are the verifier goes out of service in step 134 and displays "STACKER FULL". If any box is not full, program control returns to step 102. As suggested above, this configuration enhances the sorting flexibility and capacity of the stacker-sorter by permitting a secondary compartment to be assigned for storage of bills in the event a primary compartment is full. As shown in FIGS. 10 and 11, which respectively show the side and bottom views of carriage 30, holes 140*a* and 140*b* are provided for mounting the carriage on the guide bars 32, and additional holes 142 and 146 are provided to lighten the carriage and enhance servo system stability. A hole is provided in ram plate 62*b*, as is apparent in FIG. 2, for similar reasons. The overall weight of the moving assembly, including the carriage, circuit board, ram, ram motor and gear drive mechanism, and the receiver and retaining plate, is approximately 2 pounds. Slots 144 are provided on the top of carriage 30 for fastening retaining plate 31. Finally, carriage 30 includes two tabs 148 which serve as the motor mounts for ram motor 64.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path on one side of said inlets;

(d) position control means for selectively positioning said receiver means at a location on said path opposite the inlet of a selected one of said plurality of storage boxes; and (e) reciprocating ram means for moving the bill from said receiver means through a selected one of said inlets opposed thereto and into the associated one of said plurality of storage boxes, said ram means including means for ramming bills into more than one of said storage boxes.

2. The currency stacker-sorter of claim 1 wherein said ram means includes a ram normally located in said receiver means and means for activating said ram when said receiver means is opposite a selected one of said inlets.

3. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path on one side of said inlets;

(d) position control means for selectively positioning said receiver means at a location on said path opposite the inlet of any one of said storage boxes, wherein said position control means is a closed-loop position control system having optical encoder means for sensing the position of said receiver means on said path; and (e) ram means for moving the bill from said receiver means through an inlet opposite thereto and into the associated storage box.

4. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path one side of said inlets;

(d) position control means for selectively positioning said receiver means at a location on said path opposite the inlet of any one of said storage boxes; and (e) ram means for moving the bill from said receiver means through an inlet opposite thereto and into the associated storage box; wherein said position control means is a closed-loop position control system having optical encoder means for sensing the position of said receiver means on said path, and wherein said optical encoder means includes an encoder bar and an optical detector, said encoder bar being fixedly positioned with respect to said storage boxes and having indicia representative of each of their positions, said indicia including a plurality of successively ascending steps along the length of said encoder bar, said optical detector including means for detecting individual steps on said encoder bar, said optical encoder means including means coupled to said optical detector for generating a multi-bit actual position code for each step, and wherein said position control means includes (1) means for comparing the actual position code in value with a command position code, said comparing means including means for generating first, second and third motor control signals when the value of the command position code is respectively less than, greater than and equal to the value of the actual position code;

(2) a drive motor;

(3) means for mechanically coupling the shaft of said drive motor to said receiver means;

(4) means responsive to said first and second motor control signals for energizing said drive motor to turn in first and second opposite directions, respectively, to reduce the difference between the values of said actual and command position codes; and (5) means for stopping said drive motor in response to said third motor control signal.

5. THe currency stacker-sorter of claim 4 wherein said ram means includes a ram normally located in said receiver means and means for activating said ram when said receiver means is opposite a selected one of said inlets.

6. The currency stacker-sorter of claim 5 further comprising:

(f) means in each of said storage boxes for supporting a stack of bills, each of said supporting means including a pressure plate, spring means for urging said pressure plate toward the inlet of its associated storage box, and a scissors linkage interconnecting said pressure plate and a rear portion of its associated storage box.

7. The currency stacker-sorter of claim 6 further comprising:

(g) switch means for detecting when each scissors linkage is substantially fully retracted.

8. The currency stacker-sorter of claim 7 wherein said mechanical coupling means includes a drive spool and idler pulley mounted on opposite ends of said guide means, said drive spool being mounted on the shaft of said drive motor, carriage means for carrying said receiver means, and a drive cable wound around said drive spool and idler pulley and attached on both ends to said carriage means;

and wherein said ram means further includes a ram drive motor, a bellcrank mechanism interconnecting said ram and the shaft of said ram drive motor, and optical shaft encoder means for controlling said ram drive motor to produce one cyclical operation of said bellcrank mechanism.

9. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path on one side of said inlets;

(d) position control means for selectively positioning said receiver means at a location on said path opposite the inlet of any one of said storage boxes; and (e) ram means for moving the bill from said receiver means through an inlet opposed thereto and into the associated storage box, wherein said ram means includes a ram normally located in said receiver means and means for activating said ram when said receiver means is opposite a selected one of said inlets, and wherein said ram means further includes a ram drive motor, a bellcrank mechanism interconnecting said ram and the shaft of said ram drive motor, and optical shaft encoder means for controlling said ram drive motor to produce one cyclical operation of said bellcrank mechanism.

10. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path on one side of said inlets;

(d) position control means for selectively positioning said receiver means at a location on said path opposite the inlet of any one of said storage boxes;

(e) ram means for moving the bill from said receiver means through an inlet opposed thereto and into the associated storage box; and (f) means in each of said storage boxes for supporting a stack of bills, each of said supporting means including a pressure plate, spring means for urging said pressure plate toward the inlet of its associated storage box, and a scissors linkage interconnecting said pressure plate and a rear portion of its associated storage box.

11. The currency stacker-sorter of claim 10 further comprising:

(g) switch means for detecting when each scissors linkage is substantially fully retracted.

12. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path on one side of said inlets;

(d) position control means for selectively positioning said receiver means at a location on said path opposite the inlet of any one of said storage boxes; and (e) ram means for moving the bill from said receiver means through an inlet opposed thereto and into the associated storage box, wherein said position control means includes a drive motor, a drive spool and idler pulley mounted on opposite ends of said guide means, said drive spool being mounted on the shaft of said drive motor, carriage means for carrying said receiver means, and a drive cable wound around said drive spool and idler pulley and attached on both ends to said carriage means; and wherein said ram means includes a ram normally located in said receiver means, a ram drive motor, a bellcrank mechanisms interconnecting said ram and the shaft of said ram drive motor, and optical shaft encoder means for controlling said ram drive motor to produce one cyclical operation of said bellcrank mechanism.

13. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path on one side of said inlets;

(d) position control means for selectively positioning said receiver means at a location on said path opposite the inlet of any one of said storage boxes, wherein said position control means is a closed-loop position control system; and (e) ram means for moving the bill from said receiver means through an inlet opposed thereto and into the associated storage box.

14. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path on one side of said inlets;

(d) position control means for selectively positioning said receiver means at a location on said path opposite the inlet of any one of said storage boxes; and (e) ram means for moving the bill from said receiver means through an inlet opposed thereto and into the associated storage box, wherein said position control means is a closed-loop position control system, and wherein said position control means includes (1) an optical encoder having an encoder bar and an optical detector, said encoder bar being fixedly positioned with respect to said storage boxes and having indicia representative of each of their positions, said indicia including a plurality of successively ascending steps along the length of said encoder bar, said optical detector including means for detecting individual steps on said encoder bar, said optical encoder including means coupled to said optical detector for generating a multi-bit actual position code for each step;

(2) means for comparing the actual position code in value with a command position code, said comparing means including means for generating first, second and third motor control signals when the value of the command position code is respectively less than, greater than and equal to the value of the actual position code;

(3) a drive motor;

(4) means for mechanically coupling the shaft of said drive motor to said receiver means;

(5) means responsive to said first and second motor control signals for energizing said drive motor to turn in first and second opposite directions, respectively, to reduce the difference between the values of said actual and command position codes; and (6) means for stopping said drive motor in response to said third motor control signal.

15. The currency stacker-sorter of claim 14 wherein said mechanical coupling means includes a drive spool and idler pulley mounted on opposite ends of said guide means, said drive spool being mounted on the shaft of said drive motor, carriage means for carrying said receiver means, and a drive cable wound around said drive spool and idler pulley and attached on both ends to said carriage means.

16. A multiple-compartment currency stacker-sorter, comprising:

(a) a plurality of storage boxes for currency, each of said storage boxes having an inlet;

(b) receiver means for temporarily receiving a bill to be stored;

(c) guide means for guiding said receiver means along a path on one side of said inlets;

(d) closed-loop position control means for selectively positioning said receiver means at a location on said path opposite the inlet of any one of said storage boxes, said position control means including (1) a drive motor fixedly positioned with respect to one end of said guide means, said drive motor having a drive spool mounted on the shaft thereof;

(2) an idler pulley fixedly positioned with respect to the opposite end of said guide means;

(3) a drive cable wound around said drive spool and idler pulley and having both ends fixedly positioned with respect to said receiver means;

(4) an optical encoder having an encoder bar and an optical detector, said encoder bar being fixedly positioned with respect to said storage boxes and having indicia representative of each of their positions, said indicia including a plurality of successively ascending steps along the length of said encoder bar, said optical detector including means for detecting individual steps on said encoder bar, said optical encoder including means coupled to said optical detector for generating a multi-bit actual position code for each step;

(5) means for comparing the actual position code in value with a command position code, said comparing means including means for generating first, second and third motor control signals when the value of the command position code is respectively less than, greater than and equal to the value of the actual position code;

(6) means responsive to said first and second motor control signals for energizing said drive motor to turn in first and second opposite directions, respectively, to reduce the difference between the values of said actual and command position codes; and (7) means for stopping said drive motor in response to said third motor control signal;

(e) ram means for moving the bill from said receiver means through an inlet opposited thereto and into the associated storage box, said ram means including a ram normally located in said receiver means and means for activating said ram when said receiver means is opposite a selected one of said inlets; and (f) means in each of said storage boxes for supporting a stack of bills, each of said supporting means including a pressure plate, spring means for urging said pressure plate toward the inlet of its associated storage box, and a scissors linkage interconnecting said pressure plate and a rear portion of its associated storage box.

17. The currency stacker-sorter of claim 16 further comprising:

(g) switch means for detecting when each scissors linkage is substantially fully retracted.

18. The currency stacker-sorter of claim 17 wherein said ram means further includes a ram drive motor, a bellcrank mechanism interconnecting said ram and the shaft of said ram drive motor, and optical shaft encoder means for controlling said ram drive motor to produce one cyclical operation of said bellcrank mechanism.

19. The currency stacker-sorter of claim 16 wherein said ram means further includes a ram drive motor, a bellcrank mechanism interconnecting said ram and the shaft of said ram drive motor, and optical shaft encoder means for controlling said ram drive motor to produce one cyclical operation of said bellcrank mechanism.

20. A method of stacking and sorting currency, comprising the steps:

(a) depositing a bill temporarily into a receiver which is bidirectionally movable on a carriage along a straight guide path on one side of a plurality of currency storage boxes each having an inlet;

(b) positioning said receiver at a location on said guide path opposite a selected one of the inlets of a selected one of said plurality of storage boxes; and (c) moving with a reciprocating ram means the bill from said receiver through said selected inlet opposed thereto and into the associated one of said plurality of said storage boxes, said ram means including means for ramming bills into more than one of said storage boxes.

21. The method of claim 20 wherein said positioning step includes sensing the position of said receiver on said path and controlling the receiver position as a function of said sensed position and a desired position.

22. The method of claim 20 wherein said positioning step includes sensing the position of said receiver on said path and controlling the receiver position as a function of said sensed position and a desired position, said sensing and said controlling of said receiver position occurring with a closed-loop position control system.

23. A method of stacking and sorting currency, comprising the steps:

(a) depositing a bill temporarily into a receiver which is bidirectionally movable on a straight guide path on one side of a plurality of currency storage boxes each having an inlet;

(b) positioning said receiver at a location on said guide path opposite the inlet of a selected one of said storage boxes; and (c) moving the bill from said receiver through the inlet opposed thereto and into the associated storage box, wherein said sensing step is performed with an optical encoder having an encoder bar and an optical detector, said encoder bar being fixedly positioned with respect to said storage boxes and having indicia representative of each of their positions, said indicia including a plurality of successively ascending steps along the length of said encoder bar, said optical detector including means for detecting individual steps on said encoder bar, said optical encoder including means coupled to said optical detector for generating a multi-bit actual position code for each step; and wherein said positioning step further includes (1) comparing the actual position code with a command position code, said comparing step including generating first, second and third motor control signals when the value of the command position code is respectively less than, greater than and equal to the value of the actual position code; and (2) energizing said drive motor to turn in first and second opposite directions, respectively, to reduce the difference between the values of said actual and command position codes; and (3) stopping said drive motor in response to said third motor control signal.

24. The method of claim 23 wherein said moving step is performed with a ram normally located in said receiver, said moving step including activating said ram when said receiver is opposite a selected one of said inlets.

25. The method of claim 24 further comprising the step:

(a) supporting a stack of bills in each of said storage boxes with an individual spring-loaded pressure plate connected to a rear portion of the associated storage box by an individual scissors linkage.

26. The method of claim 25 further comprising the step:

(e) detecting a box-full condition with a switch mechanically coupled to said pressure plate.

27. The method of claim 26 wherein said positioning step is performed with a drive spool and idler pulley fixedly positioned with respect to opposite ends of said guide path, said drive spool being mounted on the shaft of said drive motor, and with a drive cable wound around said drive spool and idler pulley and having both ends fixedly positioned with respect to said receiver;

and wherein said moving step is performed with a ram drive motor and a bell crank mechanism interconnecting said ram and the shaft of said ram drive motor, said moving step including controlling said ram drive motor with an optical shaft encoder to produce one cyclical operation of said bellcrank mechanism.

* * * * *

UNITED STATES PATENT AND TRADEMARK OFFICE

CERTIFICATE OF CORRECTION

PATENT NO. : 4,844,446

DATED : July 4, 1989

INVENTOR(S) : Matthew G. Thie et al

It is certified that error appears in the above-identified patent and that said Letters Patent is hereby corrected as shown below:

In column 3, line 49, please change "41" to --42--.
In column 3, line 50, please change "M-33968" to --M-3396B--.
In column 4, line 33, please change "nay" to --any--.
In column 4, line 42, please change "FIG. 1" to --FIG. 2--.
In column 6, line 32, please change "+12 VDC" to ±12 VDC--
In column 11, line 11, please change "opposite" to --opposed--.
In column 11, line 20, after "path" please insert --on--.
In column 11, line 25, please change "opposite" to --opposed--.
In column 11, line 62, please change "THe" to --The--.
In column 13, line 30, please change "mechanisms" to --mechanism--.
In column 15, line 19, please change "opposited" to --opposed--.
In column 16, line 46, please change "(a)" to --(d)--.
In column 16, line 62, please change "bell crank" to --bellcrank--.

Signed and Sealed this

Fifth Day of June, 1990

*Attest:*

HARRY F. MANBECK, JR.

*Attesting Officer*

*Commissioner of Patents and Trademarks*